US006138777A

United States Patent [19]

Fraim et al.

[11] Patent Number: 6,138,777

[45] Date of Patent: Oct. 31, 2000

[54] HYDRAULIC UNDERREAMER AND SECTIONS FOR USE THEREIN

[75] Inventors: Michael L. Fraim, Bakersfield, Calif.; Stephen D. McCoy, Bartlesville, Okla.

[73] Assignee: Phillips Petroleum Company, Bartlesville, Okla.

[21] Appl. No.: 09/385,614

[22] Filed: Aug. 30, 1999

Related U.S. Application Data

[60] Provisional application No. 60/119,624, Feb. 11, 1999.

[51] Int. Cl.[7] ..... E21B 21/12; E21B 7/18

[52] U.S. Cl. ..... 175/92; 175/215

[58] Field of Search ..... 175/92, 102, 64, 175/67, 215, 324, 424; 299/17, 16; 166/308, 305.1

[56] References Cited

U.S. PATENT DOCUMENTS 4,296,970 10/1981 Hodges ..... 299/67
4,934,466 6/1990 Paveliev et al. ..... 175/102
5,366,030 11/1994 Pool, II et al. ..... 175/215
5,494,108 2/1996 Palmer et al. ..... 166/308
5,505,262 4/1996 Cobb ..... 166/312

*Primary Examiner*—Robert E. Pezzuto
*Attorney, Agent, or Firm*—Richmond, Hitchcock, Fish & Dollar

[57] ABSTRACT

A hydraulic underreamer for enlarging a wellbore includes improved packer, cutting, jet pump, and mill sections. Each of the sections and their associated advantages are described herein in detail. The packer section is designed to minimize wear on its sealing elements, the cutting and jet pump sections are designed to minimize pressure requirements and optimize hydraulic efficiency, and the mill section has a removable center assembly which allows effective well control when pulling the underreamer out of a "live" well filled with a gas, such as methane.

2 Claims, 8 Drawing Sheets

HYDRAULIC UNDERREAMER AND SECTIONS FOR USE THEREIN

This application claims the benefit of U.S. provisional application Ser. No. 60/119,624 filed Feb. 11, 1999.

BACKGROUND OF THE INVENTION

The invention relates to a hydraulic underreamer and improved sections for use therein.

A hydraulic underreamer is used to hydraulically wash out or more typically enlarge a wellbore extending through a subterranean formation to thereby create a cavity in the formation. Hydraulic underreaming can be applied to a coal formation ("coal seam") to enhance the production of methane flowing from fractures ("cleats") in such a formation, or to other formations in which enlargement of a wellbore is desired.

One type of hydraulic underreamer includes: a packer section for sealing against a well casing so as to isolate an annulus above the packer section as defined between the casing and a work pipe; a cutting section for hydraulically enlarging a wellbore below the casing to thereby produce a mixture of liquid and formation fragments in the resulting cavity; and a jet pump section for pumping mixture from the cavity for passage through the above-mentioned annulus to the surface.

SUMMARY OF THE INVENTION

It is an object of the invention to provide improved packer, cutting, and jet pump sections, as well as a novel mill section, for use in a hydraulic underreamer.

A packer section is provided which comprises: a tubular drive bushing having an upper end and a lower end; a tubular packer mandrel having an upper end and a lower end, the packer mandrel being mounted on the drive bushing with the packer mandrel lower end being closely adjacent to but not connected to the drive bushing upper end so that the drive bushing may rotate while the packer mandrel remains stationary; at least one tubular sealing element received on and around the packer mandrel; a tubular drive mandrel defining a packer section central bore therethrough and substantially coaxially extending through the drive bushing and packer mandrel so as to define a packer section annulus, the tubular drive mandrel being fixedly connected to the drive bushing so that rotation of the drive mandrel rotates the drive bushing.

A cutting section is provided which comprises: an outer pipe; an inner pipe defining a cutting section central bore therethrough and extending substantially coaxially through the outer pipe to define a cutting section annulus between the inner and outer pipes; a cutting nozzle housing extending through the cutting section annulus between the inner and outer pipes so as to be fixedly connected thereto, the cutting nozzle housing having an inlet portion in communication with the cutting section central bore and also having an outlet portion; a baffle mounted in the housing inlet portion; and a cutting nozzle mounted in the housing outlet portion.

A jet pump section is provided which comprises: a body having a longitudinal axis, a longitudinally extending pump section central bore with an upper end defining an inlet and a lower end defining an outlet, and a plurality of turn chambers circumferentially spaced around the pump section central bore, each turn chamber having at least one inlet passageway, in communication with the pump section central bore, and also having an outlet; a plurality of ejector nozzles corresponding to the plurality of turn chambers such that each ejector nozzle has an inlet in communication with a corresponding turn chamber outlet, each ejector nozzle also having an outlet; a plurality of venturis corresponding to the plurality of ejector nozzles such that each venturi has an inlet aligned with but spaced above a corresponding ejector nozzle outlet, each venturi also having an outlet; wherein the body further has defined therein a diffusion chamber surrounding the pump section central bore, the diffusion chamber having a plurality of inlets in respective communication with the venturi outlets and also having a substantially annular outlet adjacent to the inlet of the pump section central bore.

A mill section is provided which comprises: a tubular bit sub having an upper end and a lower end; a tubular primary mill having an upper end, removably connected to the bit sub lower end, and also an abrasive lower end; and a center assembly having a passageway therethrough and adapted to be received in a mill section central bore defined in the bit sub and primary mill, wherein the center assembly includes (i) a locking mandrel having an upper end and a lower end and being selectively lockable in the mill section central bore, (ii) a center mill having an upper end removably connected to the locking mandrel lower end and also having an abrasive lower end adjacent to the primary mill lower end when the locking mandrel is locked in the mill section central bore, and (iii) a mill nozzle connected to the center mill lower end so as to be in communication with the center assembly passageway.

There is also provided a hydraulic underreamer comprising the above-described sections, as well as an intermediate section, connected together in a string in a manner further described below.

Operational advantages of this invention are discussed in the context of preferred embodiments in the Detailed Description of the Invention.

DETAILED DESCRIPTION OF THE INVENTION

The hydraulic underreamer and its operation as described below assumes that a wellbore is being enlarged to enhance methane production from a coal seam. It should be understood, however, that the hydraulic underreamer of the invention can be used to enlarge a wellbore for any purpose. Any dimensions in the following description are provided only as typical examples, and should not be construed to limit the invention in any manner.

Figure 1:
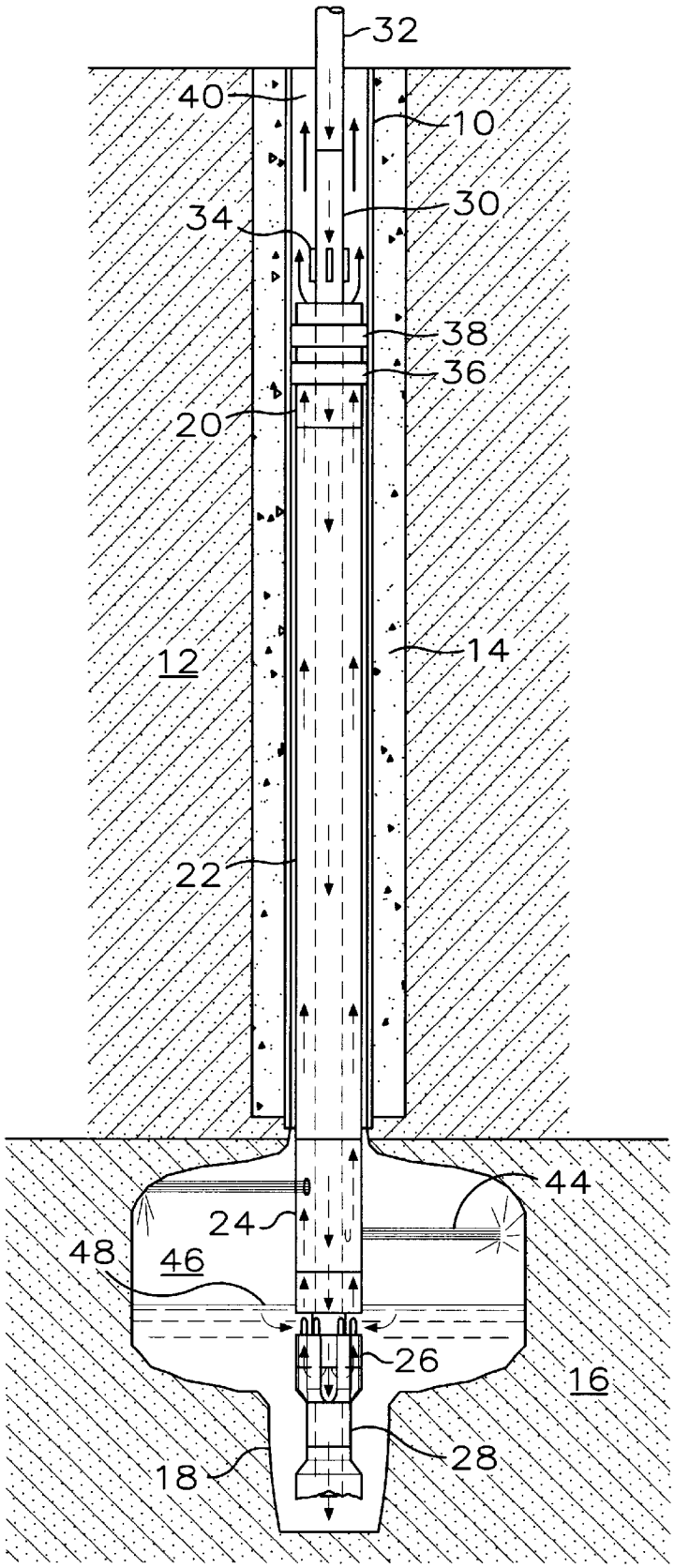
FIG. 1 is a schematic representation of an operating hydraulic underreamer in accordance with the invention and having the various sections discussed above.

Referring to FIG. 1, a well casing 10 extends through overburden 12, and is cemented in the overburden as indicated at 14. The lower end of well casing 10 is shown as being just above a coal seam 16. A previously drilled wellbore 18 extends through coal seam 16.

The illustrated hydraulic underreamer comprises a number of sections connected together in a string. Such sections include (from top to bottom) a packer section 20, an intermediate section 22 comprising a coaxial pipe string, a cutting section 24, a jet pump section 26, and a mill section 28. Packer section 20 has an associated drive mandrel 30 connected at its upper end to a work pipe 32, which extends to the surface (not shown). Cleaning blades 34 are circumferentially affixed to drive mandrel 30. Sealing elements 36 and 38 of the packer section function to seal against well casing 10 and thereby isolate a casing annulus 40 defined above the sealing elements. Packer section 20, as well as the other sections, have substantially straight and aligned central bores as schematically indicated. An annulus surrounds the central bore in packer section 20, intermediate section 22, and cutting section 24. When using a 7 inch well casing, it is typical to employ a central bore diameter of 3½ inches and an annulus outer diameter of 6 inches.

In operation, work pipe 32 is rotated to thereby rotate drive mandrel 30. As will be explained in detail with reference to FIG. 2, packer section 20 is constructed so that sealing elements 36 and 38 do not rotate upon rotation of drive mandrel 30. This minimizes wear on the sealing elements so as to require less frequent replacement than conventional rotating sealing elements. The hydraulic underreamer can be moved up or down without losing the desired seal between the sealing elements and well casing 10. Rotation of drive mandrel 30 causes rotation of each of the other sections. Rotation of mill section 28 will drill through possible obstructions lying in or across wellbore 18, such as formation fragments or even, on rare occasions, metal "junk" or other debris as may be encountered.

The liquid used is most typically water with one or more viscosity and/or density increasing additives. Such liquid is pumped into and through work pipe 32 at a pressure and flow rate which are selected based upon a number of factors, including well depth, well size, sizes of various nozzles (described below), the methane pressure in the coal seam, and also safety considerations. The pressure is typically within the range of 1000–3000 psi, and the flow rate is typically within the range of 350–1000 gpm (gallons per minute).

As indicated by the broken arrows, liquid flows downwardly from work pipe 32, through the upper portion of drive mandrel 30 and then through a lower portion of the drive mandrel defining the central bore of packer section 20, through the central bore of intermediate section 22, and through the central bore of cutting section 24. Some of the liquid is diverted to flow through diametrically opposed cutting nozzles to produce cutting streams 42 and 44. Such opposed cutting streams, balancing the forces on the underreamer to minimize structural stress, impact the surrounding walls of coal seam 16 to break off formation fragments. These fragments are referred to generically as formation fragments since some formation materials other than coal, such as shale, may also be present in coal seam 16. An upper portion of wellbore 18, indicated by phantom lines (broken lines with alternating dots), is shown as having been enlarged by cutting streams 42 and 44 to form a cavity 46. A mixture of liquid and formation fragments results, the surface upper level of which is indicated at 48.

That liquid not diverted to the cutting nozzles continues its downward flow into the central bore of jet pump section 26. A portion of this liquid flows completely through the pump section central bore, and then through mill section 28 to cool its abrasive lower end and to help carry cuttings away from such lower end. Another portion of the liquid exits the pump section central bore and changes in flow direction to flow upwardly. Mixture is drawn into a portion of jet pump section 26 (as indicated by solid arrows) and then flows upwardly through such portion, providing the formation fragments are sufficiently small as achieved by the action of cutting streams 42 and 44 as well by the jet pump section itself by a novel means subsequently described. Mixture flows into and through the annulus of cutting section 24, through the annulus of intermediate section 22, and through the annulus of packer section 20 so as to exit such annulus to flow into casing annulus 40 (as indicated by solid arrows). Rotation of cleaning blades 34 keeps the casing annulus 40 cleaned out immediately above the packer section annulus to assist in constant and unobstructed flow therefrom. Mixture continues its upward flow through casing annulus 40 to the surface (not shown).

Preferably, jet pump section 26 pumps mixture to the surface at a sufficient volumetric flow rate to maintain the upper level of mixture 48 below cutting section 24. A gas cap can result between mixture 48 and sealing elements 36 and 38, through which cutting streams 42 and 44 operate efficiently at greater distances than they do through liquid.

After having been pumped to the surface, the mixture of liquid and formation fragments, also containing some methane, is typically passed into a pit where natural separation of the mixture components occurs. The formation fragments fall to the bottom of the pit, leaving the liquid on top for recycling if desired. Methane escaping from the liquid will typically be contained and is immediately burned for safety reasons. As a cavity is formed the hydraulic underreamer is moved down wellbore 18 through coal seam 16 to continue the underreaming operation. Upon completion of the operation, the hydraulic underreamer is withdrawn from the well, and the well is equipped for production of methane in a conventional manner.

Preferred embodiments of packer section 20, cutting section 24, jet pump section 26, and mill section 28 will now be described. The preferred material of construction for each section is a suitable heat treated steel unless otherwise noted for certain components. All fixed connections hereafter described are preferably welded connections.

Figure 2:
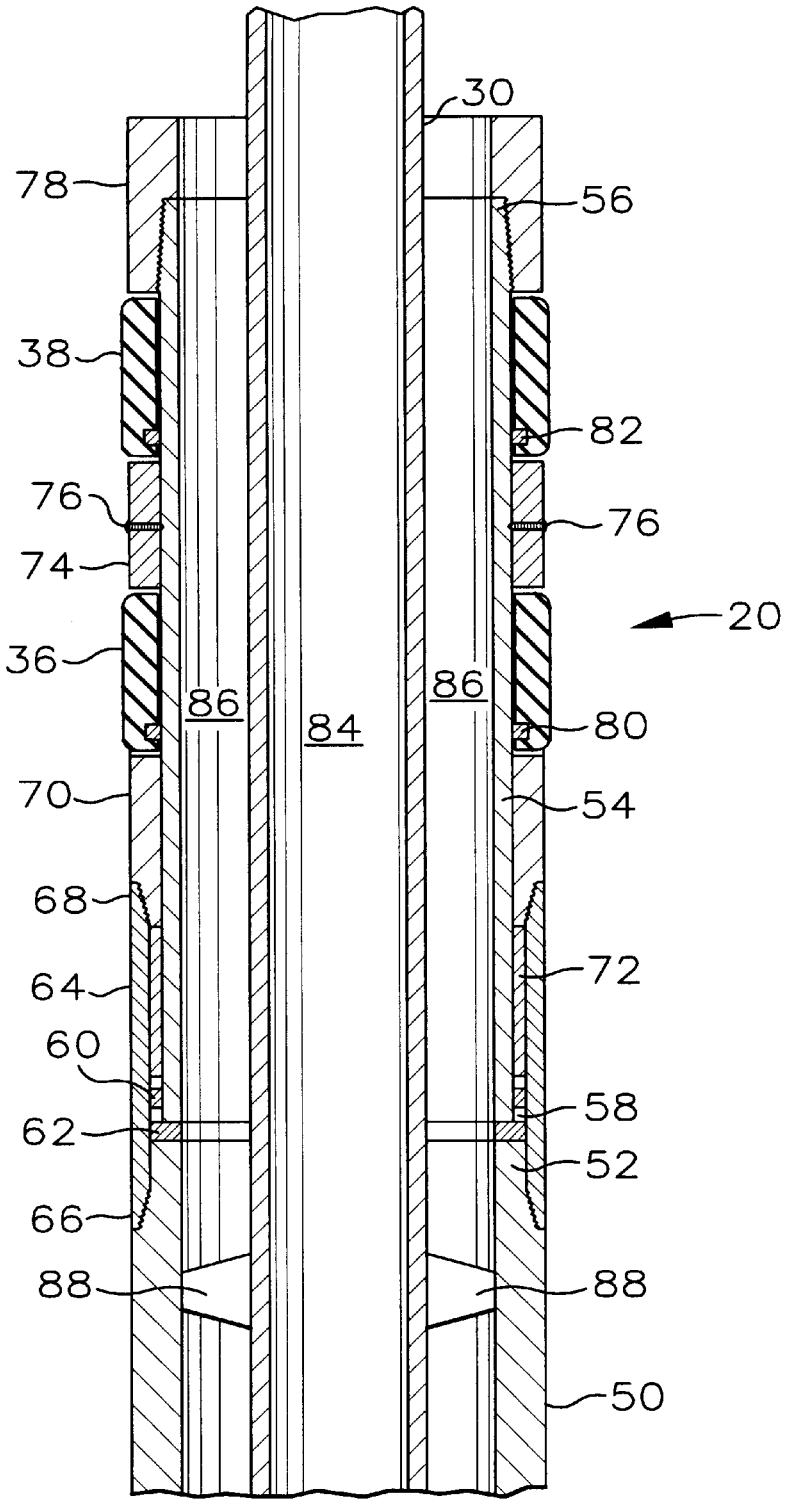
FIG. 2 is a longitudinal cross-sectional view of a preferred embodiment of the packer section.

Referring to FIG. 2, the illustrated packer section 20 includes a tubular drive bushing 50 having an externally threaded upper end 52. A tubular packer mandrel 54 has an externally threaded upper end 56 and a flanged lower end 58 with O-rings 60 received in a circumferential recess. Packer mandrel 54 is mounted on drive bushing 50 such that packer mandrel lower end 58 is closely adjacent to but not connected to drive bushing upper end 52. As shown, a substantially annular thrust bearing 62 (preferably brass, or other suitable bearing material) is interposed between drive bushing upper end 52 and packer mandrel lower end 58.

A bearing housing 64 has an internally threaded lower end 66 threadedly connected to drive bushing upper end 52, and also an internally threaded upper end 68 threadedly connected to a bearing housing nut 70. Accordingly, bearing housing 64 surrounds and encases thrust bearing 62 and a lower portion of packer mandrel 54, and is in sealing contact with O-rings 60. A tubular load bearing 72 (preferably brass, or other suitable bearing material) is interposed between bearing housing 64 and the lower portion of the packer mandrel.

Sealing elements 36 and 38 are received on and around packer mandrel 54, and a tubular spacer 74 is received on and around packer mandrel 54 between the sealing elements. Spacer 74 is preferably held in position by set screws 76. A packer mandrel nut 78 is threadedly connected to packer mandrel upper end 56 so that sealing elements 36 and 38 are positioned between the packer mandrel nut and bearing housing nut 70. There is preferably at least a small space between the lower end of spacer 74 and the upper end of sealing element 36, and a similar space between the lower end of packer mandrel nut 78 and the upper end of sealing element 38. Liquid may enter through these spaces for reasons apparent below.

Each of the sealing elements can be composed of a synthetic or natural rubber. Sealing element 36 has a sealing ring 80 embedded near its lower end, and sealing element 38 similarly has a sealing ring 82 embedded near its lower end. Each sealing ring comprises a metal ring and an O-ring which seals against the outer surface of packer mandrel 54. As shown, each sealing element has an internal diameter which tapers from the upper end of the sealing element to the sealing ring. Therefore, a small tapered gap exists between the inner surface of the sealing element and the outer surface of packer mandrel 54. When beginning operation of the hydraulic underreamer, flow of liquid into this gap expands the sealing elements 36 and 38 sufficiently to seal against the well casing.

Tubular drive mandrel 30 defines a packer section central bore 84 therethrough, and coaxially extends through packer mandrel 54 and drive bushing 50 so as to define a packer section annulus 86. Drive mandrel 30 is fixedly connected to drive bushing 50 by means of connecting members 88. Therefore, rotation of drive mandrel 30 rotates drive bushing 50, but packer mandrel 54 and associated sealing elements 36 and 38 can remain stationary.

The lower ends of drive mandrel 30 and drive bushing 50 are not shown, but can be provided with any suitable means for connection to the upper end of intermediate section 22 (FIG. 1), such that the intermediate section central bore and annulus respectively communicate with packer section central bore 84 and packer section annulus 86.

Figure 3:
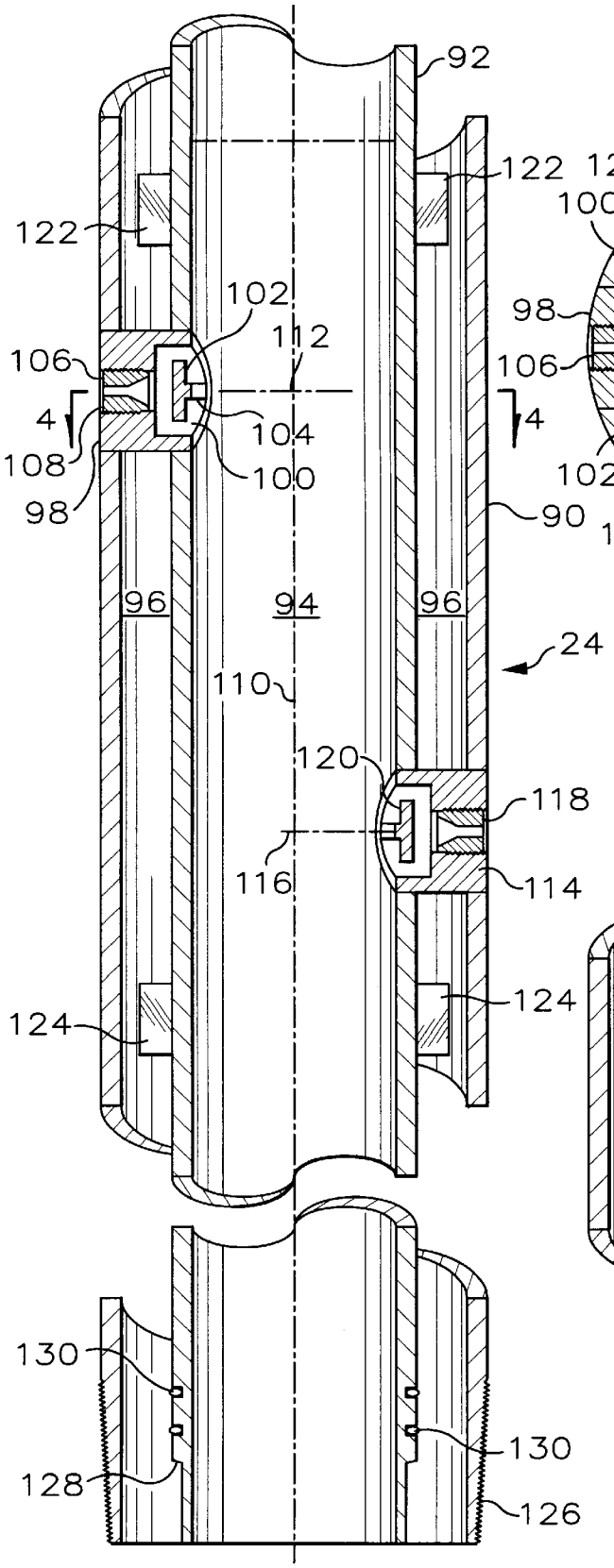
FIG. 3 is a longitudinal cross-sectional view of a preferred embodiment of the cutting section.

Referring to FIG. 3, the illustrated cutting section 24 includes an outer pipe 90 and an inner pipe 92. Inner pipe 92 defines a cutting section central bore 94 therethrough, and extends coaxially through outer pipe 90 to define a cutting section annulus 96 between outer pipe 90 and inner pipe 92. An upper cutting nozzle housing 98 extends through cutting section annulus 96 between the inner and outer pipes so as to be fixedly connected thereto. Cutting nozzle housing 98 has an inlet portion 100 in communication with cutting section central bore 94. A baffle 102 is mounted in housing inlet portion 100 by means of bar 104 (as will be further explained below). A cutting nozzle 106 (preferably tungsten carbide) is threadedly and removably connected to cutting nozzle housing 98 within an outlet portion 108 thereof. As shown, cutting nozzle 106 has a passageway tapering from an inlet, adjacent to baffle 102 and having an inlet diameter, to an outlet having outlet diameter smaller than the inlet diameter. The inlet end of cutting nozzle 106 preferably sealingly engages an O-ring as shown.

Outer pipe 90 and inner pipe 92 have the same longitudinal axis 110, hereafter denoted as pipe axis 110. Cutting nozzle housing 98 has a longitudinal axis 112, hereafter denoted as housing axis 112, substantially perpendicular to and intersecting pipe axis 110. Cutting nozzle 98 and baffle 102 are aligned along housing axis 112, and baffle 102 is substantially perpendicular to housing axis 112.

A lower cutting nozzle housing 114 has, similarly to cutting nozzle housing 98, a housing axis 116 and has a cutting nozzle 118 and baffle 120 mounted therein. Housing axes 112 and 116 are substantially coplanar, and cutting nozzle housings 98 and 114 are on opposite sides of pipe axis 110. Housing axes 112 and 116 are longitudinally spaced from one another along pipe axis 110. Such longitudinal spacing for a 6 inch outer pipe is preferably in the range of about 12–24 inches.

A first set of three (only two of which are visible in FIG. 3) circumferentially spaced centralizers 122, positioned in cutting section annulus 96 above cutting nozzle housing 98, extend between and are fixedly connected to outer pipe 90 and inner pipe 92. A second set of centralizers 124 are similarly provided below cutting nozzle housing 114.

Outer pipe 90 has an externally threaded lower end 126, and inner pipe 92 has a lower end 128 with a pair of O-rings 130 in circumferential external recesses. As shown, inner pipe lower end 128 steps down in wall thickness below O-rings 130. The upper ends of outer pipe 90 and inner pipe 92 are not shown, but can be provided with any suitable means for connection to the lower end of intermediate section 22 (FIG. 1), such that cutting section central bore 94 and cutting section annulus 96 are in respective communication with the intermediate section central bore and annulus.

An upper portion of cutting section 24 is broken away, as well as a middle portion, so that the full length of cutting section 24 is not shown. However, a typical length for cutting section 24 is in the range of about 5–7 feet.

Figure 4:
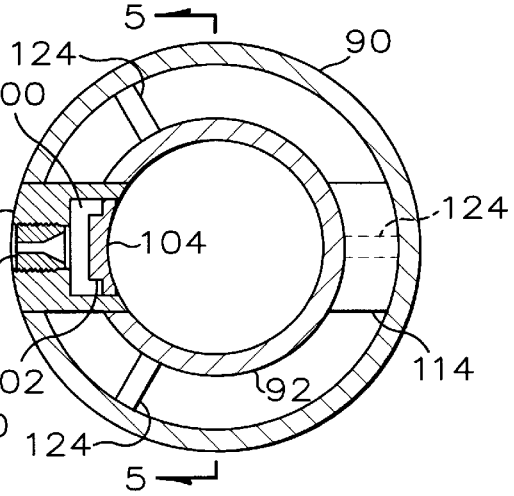
FIG. 4 is a cross-sectional view of the cutting section as viewed along line 4—4 in FIG. 3.

Referring to FIG. 4, this cross-sectional view shows the manner in which bar 104 transversely extends across housing inlet portion 100 between opposing ends fixedly connected to cutting nozzle housing 98. Baffle 102 is fixedly connected to bar 104. Two centralizers 124 are shown by solid lines in FIG. 4, as well as a third centralizer 124, indicated by broken lines, immediately below cutting nozzle housing 114.

Figure 5:
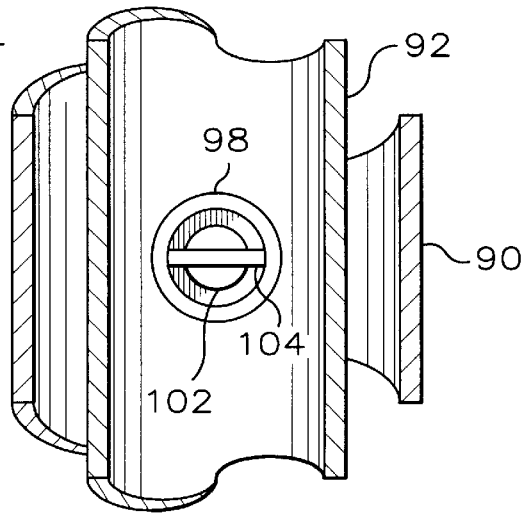
FIG. 5 is a cross-sectional view of the cutting section as viewed along line 5—5 in FIG. 4.

Referring to FIG. 5, this cross-sectional view shows baffle 102 as being a disk which is circular in shape. Of course, baffle 120 is also preferably a disk.

The baffle in each cutting nozzle housing desirably reduces the pressure required to obtain a desired flow through the cutting nozzle.

Figure 6:
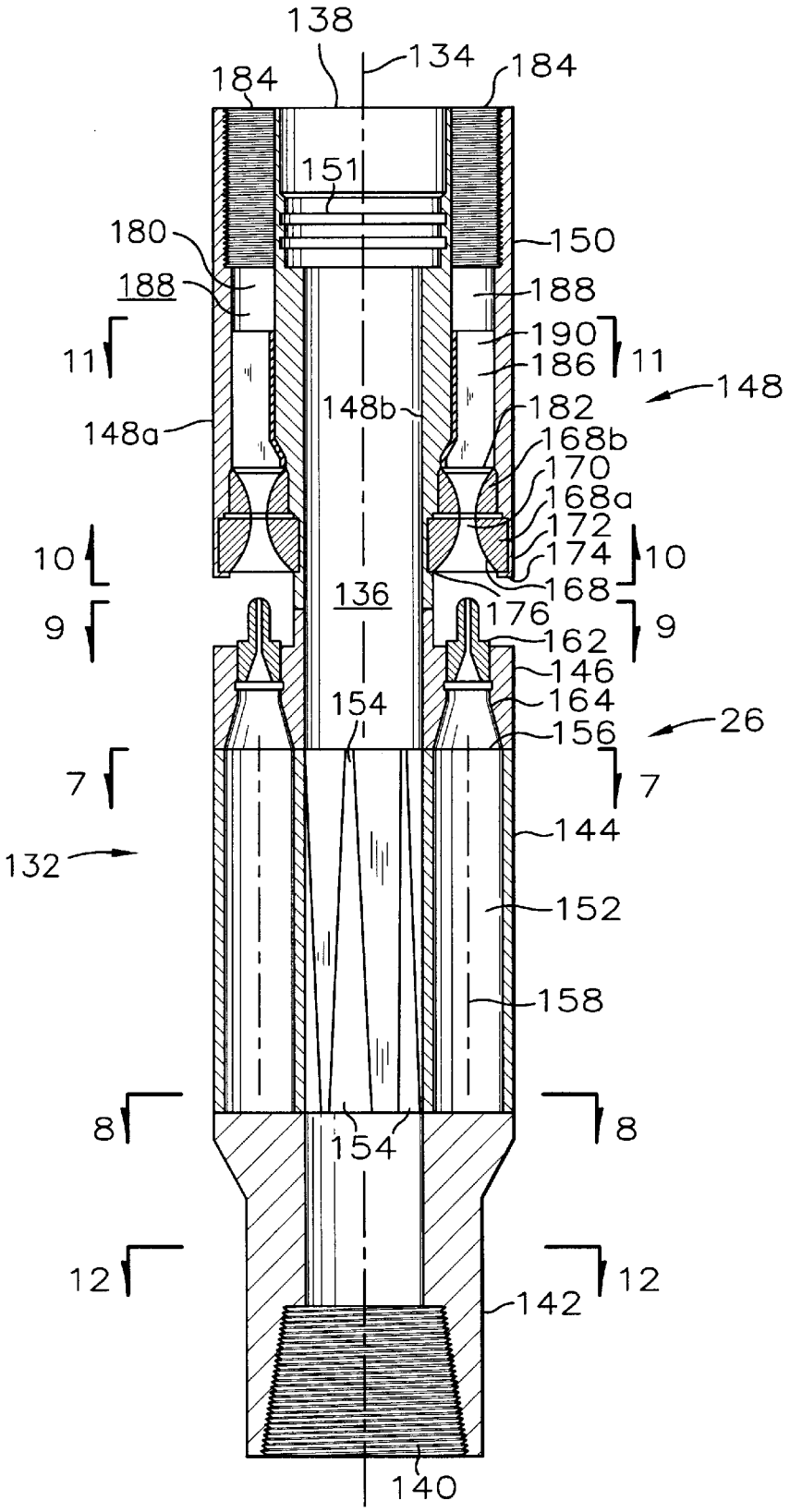
FIG. 6 is a longitudinal cross-sectional view of a preferred embodiment of the jet pump section.

Referring to FIG. 6, the illustrated jet pump section 26 includes a body 132 having a longitudinal axis 134 and a longitudinally extending pump section central bore 136. Pump section central bore 136 has an upper end defining an inlet 138 and a lower end defining an outlet 140. For ease of fabrication, body 132 includes body portions 142, 144, 146, 148, and 150 fixedly connected together as shown. Body portion 148 has a generally annular subportion 148*a* (to which the lower end of body portion 150 is connected) and a tubular body subportion 148*b* (positioned inside body portion 150) integral with body subportion 148*a*. Body subportion 148*b* has an upper end with a pair of O-rings 151 in internal circumferential recesses. As shown, the upper end of body subportion 148*b* steps down in wall thickness above O-rings 151. Finally with respect to the body, body portion 142 has an internally threaded lower end.

Figure 7:
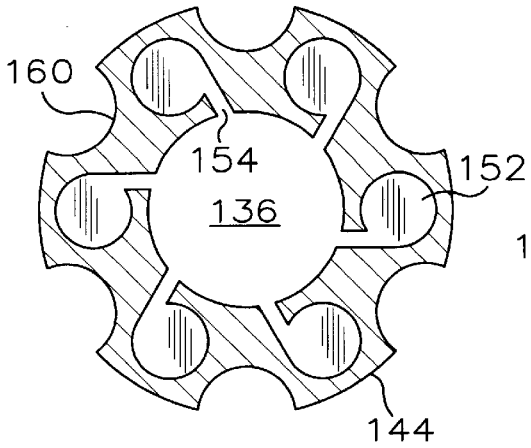
FIGS. 7–12 are cross-sectional views of the jet pump section as viewed along lines 7—7, 8—8, 9—9, 10—10, 11—11, and 12—12, respectively, in FIG. 6.
Figure 8:
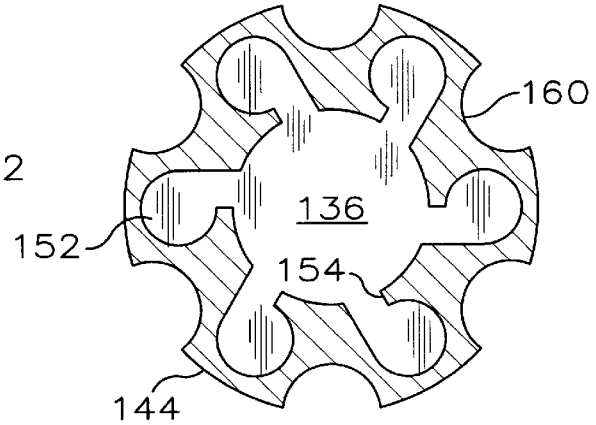

Referring to FIG. 6 in conjunction with FIGS. 7 and 8, body portion 144 has defined therein a plurality (six in this particular embodiment) of turn chambers 152 circumferentially spaced around pump section central bore 136. Each turn chamber 152 has an inlet passageway 154 in communication with pump section central bore 136. Each turn chamber 152 also has an outlet 156, and is elongated so as to longitudinally extend along side pump section central bore 136. Additionally, each turn chamber 152 has a longitudinally extending central axis 158. Inlet passageway 154 is preferably offset from central axis 158. This produces a spinning effect in liquid flowing upwardly through the turn chamber. This effect lowers the pressure loss which naturally results from the change in flow direction. Each inlet passageway 154 also preferably tapers in width from its lower end to its upper end. This desirably produces progressively increasing inlet flow into turn chamber 152 from its upper end to its lower end. FIGS. 7 and 8 also show a plurality of external grooves 160 in body portion 144, as will be further explained below.

Figure 9:
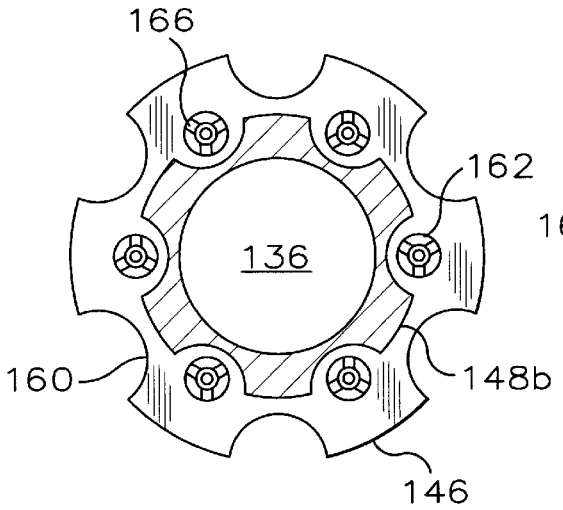

Referring to FIG. 6 in conjunction with FIG. 9, a plurality of ejector nozzles 162 (preferably tungsten carbide), corresponding to the plurality of turn chambers 152, are threadedly and removably connected to and partially within body portion 146. Each ejector nozzle 162 has an inlet in communication with a corresponding turn chamber outlet 156 through a tapered passage 164 in body portion 146. As shown, the inlet end of each ejector nozzle 162 sealingly engages an O-ring, and each ejector nozzle has a passageway which tapers from its inlet, having an inlet diameter, to an outlet having an outlet diameter smaller than the inlet diameter. FIG. 9 also shows notches 166 in each ejector nozzle 162 for engagement by a suitable nozzle wrench, and also the continuation of grooves 160 in body portion 146.

Figure 10:
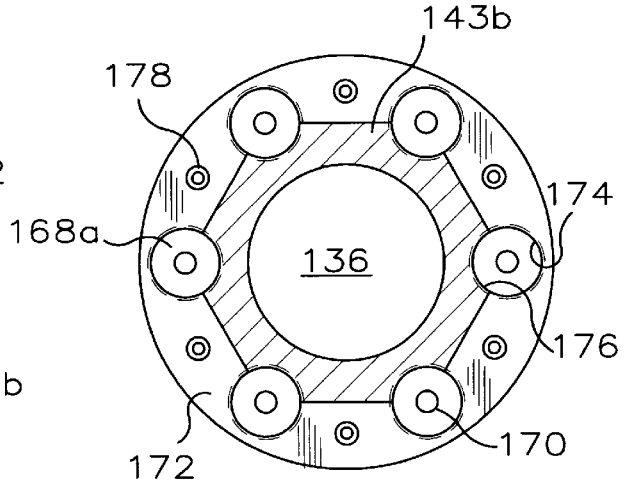

Referring to FIG. 6, a plurality of venturis 168, corresponding to the plurality of ejector nozzles 162, are received by body portion 148. Each venturi 168 has an inlet aligned with but spaced (typically about ½–¾ inch) above a corresponding ejector nozzle outlet. Each venturi 168 has a passageway tapering from the venturi inlet to a throat 170 (typically about ½–¾ inch in diameter), and flaring from the throat to a venturi outlet. In the illustrated embodiment, each venturi 168 is comprised of a lower throat nozzle 168*a* and an upper throat nozzle 168*b* oriented end to end so as to define the desired venturi passageway having throat 170. An O-ring is located at the junction of throat nozzles 168*a* and 168*b*. A retainer ring 172 having lips 174, in conjunction with lips 176 associated with body subportion 148*b*, serves to removably secure the throat nozzles in position. Retainer ring 172 is best shown in FIG. 10. Screws 178 extend through retainer ring 172 and are threadedly and removably received in body subportion 148*a* (FIG. 6). The periphery of each throat nozzle 168*a* is indicated by a circular broken line. A lip 174 slightly overlaps a portion of such periphery, and lip 176 overlaps the remaining portion. Throats 170 are also shown in FIG. 10.

In addition to the desired jet pump effect achieved by flow of an ejector stream into and through a corresponding venturi, the high velocity ejector stream from an ejector nozzle outlet will break up an immediately adjacent formation fragment which will not otherwise pass through the venturi throat because of excessive size and/or irregular shape. This capability of the inventive jet pump section results in improved hydraulic efficiency, as compared to the conventional hydraulic underreamer which relies entirely on its cutting stream (usually acting at long distances) to hydraulically produce formation fragments that will pass through its jet pump.

Figure 11:
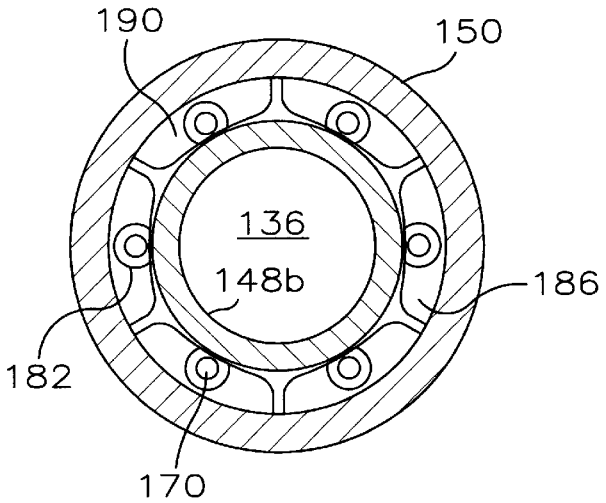

Referring now to FIG. 6 in conjunction with FIG. 11, a diffusion chamber 180 between body subportion 148*b* and body portion 150 has a plurality of inlets 182 in respective communication with the venturi outlets, and also has a substantially annular outlet 184 adjacent to the inlet 138 of pump section central bore 136. Diffusion chamber 180 includes a plurality of diffusion subchambers 186 and a substantially annular subchamber 188. Diffusion subchambers 186 are defined by a diffuser member 190 fixedly connected between body subportion 148*b* and body portion 150. Diffusion subchambers 186 extend from respective diffusion chamber inlets 182 to annular subchamber 188, and annular subchamber 188 extends to annular outlet 184. FIG. 11 also shows throats 170.

Figure 12:
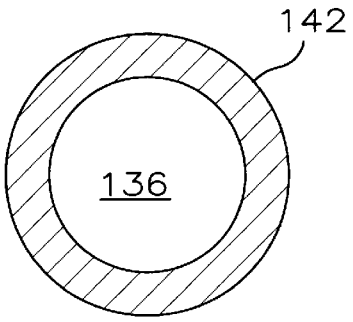

FIG. 12 shows a cross-sectional view of body portion 142.

Figure 13:
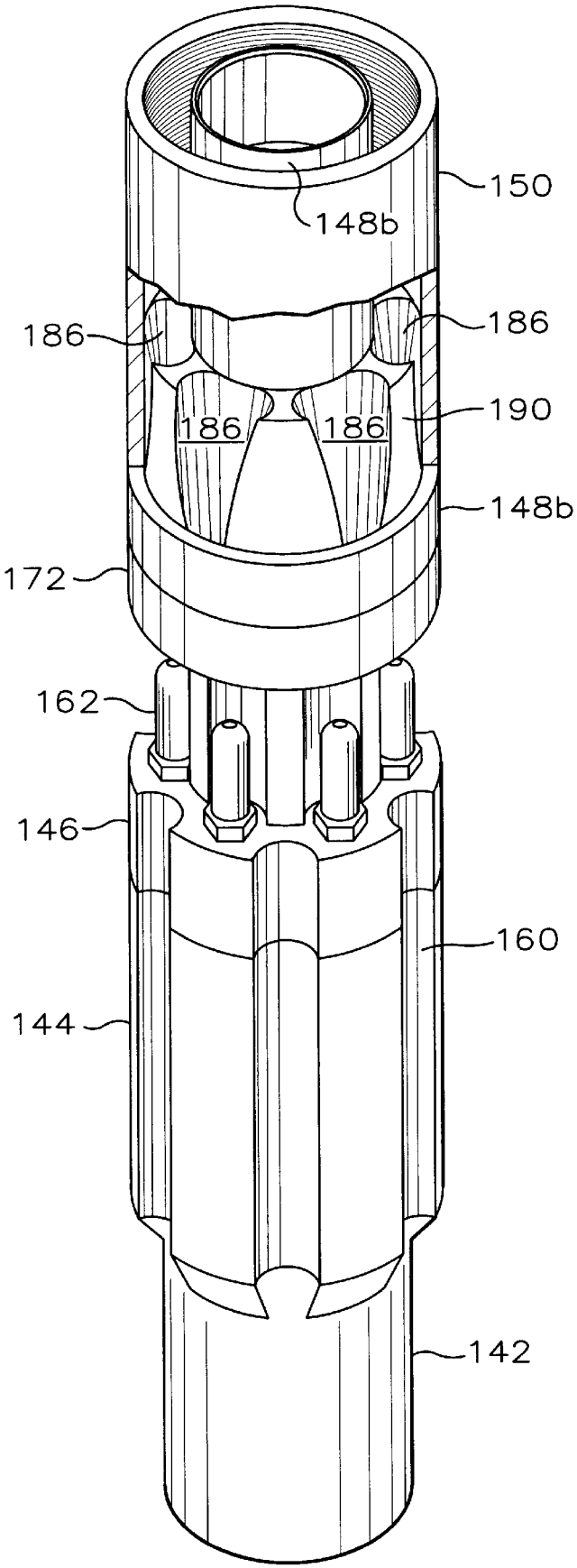
FIG. 13 is a perspective view of the jet pump section with a portion of its body broken away to show internal details.

FIG. 13 has a portion of body portion 150 broken away to more clearly illustrate the structure of diffuser member 190 and the diffusion subchambers 186 defined thereby. As shown, diffusion subchambers 186 flare upwardly. FIG. 13 also shows a perspective view of the various body portions and subportions, grooves 160, ejector nozzles 162, and retainer ring 172. In particular, FIG. 13 shows that each groove 160 longitudinally extends from a lower end to an upper end adjacent to ejector nozzles 162.

With reference again to FIG. 6 as well as FIG. 3, jet pump section 26 is connectable to cutting section 24. The upper end of body portion 150 can be threadedly connected to outer pipe lower end 126 so that annular outlet 184 communicates with cutting section annulus 96, and the upper end of body subportion 148*b* can be sealingly connected with inner pipe lower end 128 so that pump section central bore 136 communicates with cutting section central bore 94.

Figure 14:
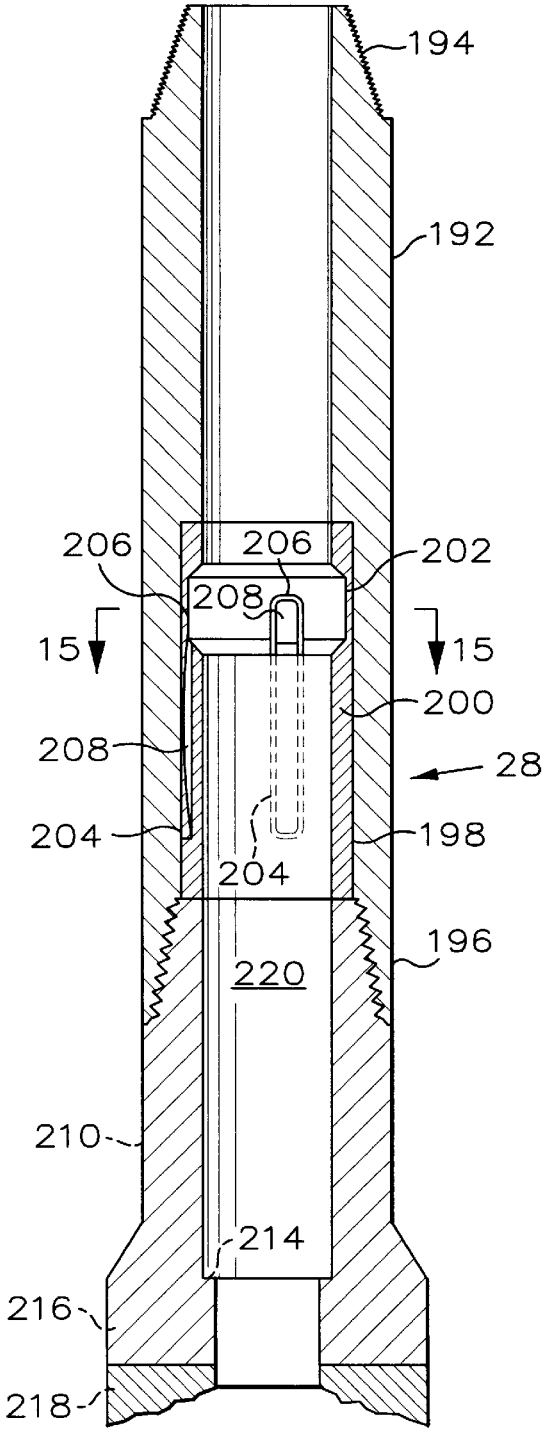
FIG. 14 is a longitudinal cross-sectional view of a preferred embodiment of the mill section without a center assembly therein.

Referring to FIG. 14, the illustrated mill section 28 (without center assembly, which is discussed below) includes a tubular bit sub 192 having an externally threaded upper end 194 and an internally threaded lower end 196. Bit sub 192 also has an internal circumferential recess 198, hereafter denoted as the bit sub recess 198, adjacent to bit sub lower end 196.

A tubular insert 200, tightly and securely received in bit sub recess 198, has an internal circumferential recess 202 which is hereafter denoted as the insert recess 202. Insert 200 also has three circumferentially spaced and longitudinally extending slots 204. Only two of slots 204 are shown in FIG. 14, where one is shown in cross section and the other is indicated by a broken line. Each slot 204 extends from a lower end to an upper end at which it intersects insert recess 202 to create an opening 206. In addition, each slot 204 receives an elongated but slightly curved finger 208 (one in cross section and the other in broken and solid lines) having a lower end, fixedly connected to insert 200 (i.e. with a rivet), and an upper end extending through opening 206 into insert recess 202. Contact with bit sub 192 in bit sub recess 198 forces finger 208 into this position from a previously relaxed position the finger assumes prior to insertion of insert 200 into bit sub recess 198. Each finger 208 is composed of a suitably flexible and resilient material, preferably spring steel.

A tubular primary mill 210 has an externally threaded upper end 212 removably connected to bit sub lower end 196. Primary mill upper end 212 is suitably tightened against the lower end of insert 200 to provide a good compression fit in bit sub recess 198. Therefore, insert 200 will rotate with bit sub 192 during operation, as will be more apparent below. Primary mill 210 also has an internal shoulder 214 and an abrasive lower end 216. Abrasive lower end 216 includes a lower abrasive layer 218 composed of a suitably hard material (preferably tungsten carbide brazed onto steel).

Bit sub 192, insert 200, and primary mill 210 define a mill section central bore 220 therethrough.

Figure 15:
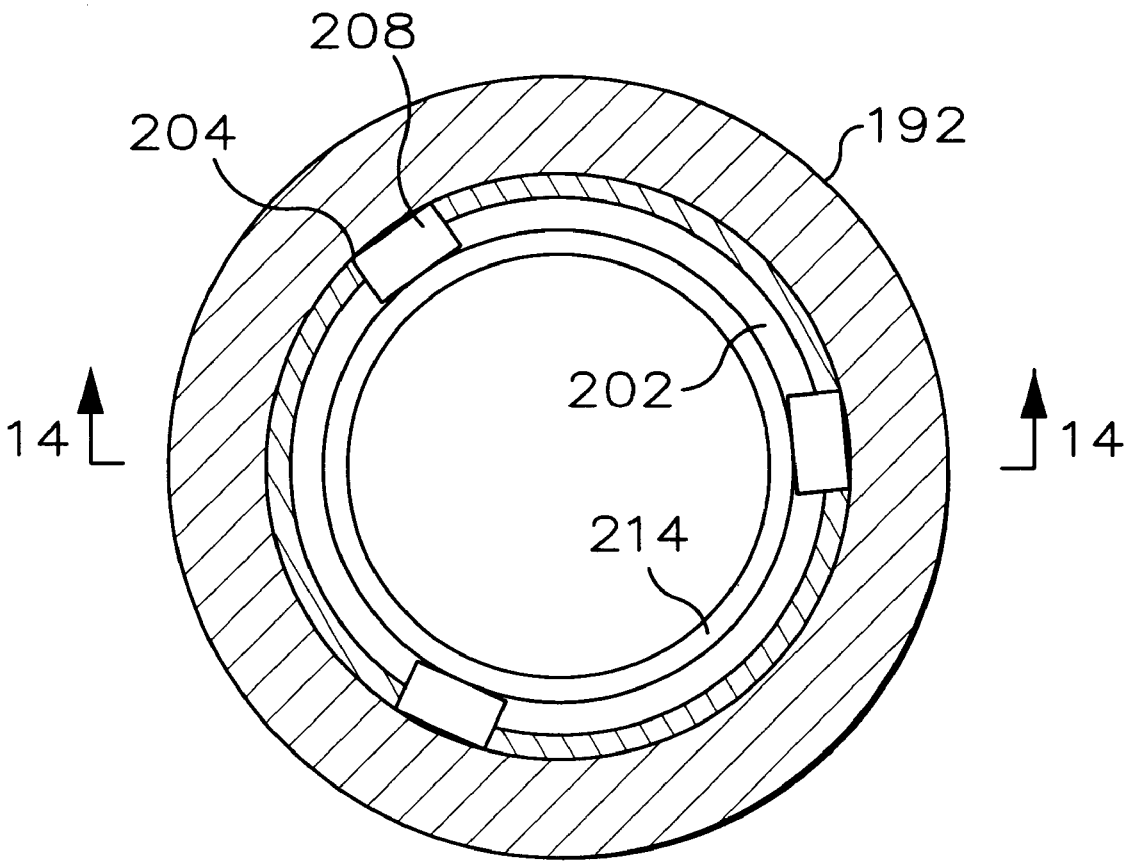
FIG. 15 shows an enlarged cross section as viewed along line 15—15 in FIG. 14.

Referring to FIG. 15, this cross-sectional view shows the third finger 208 and its corresponding slot 204. FIG. 15 provides an end view of each of the fingers extending into insert recess 202. FIG. 15 also shows shoulder 214.

Figure 16:
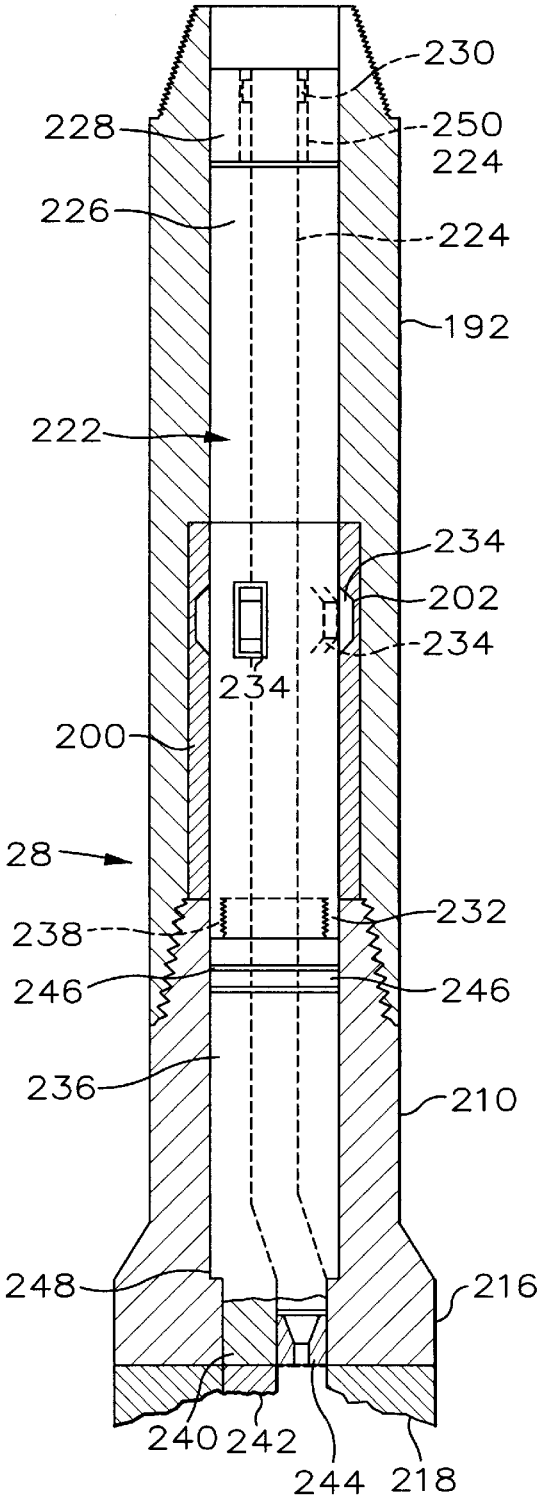
FIG. 16 is a view of the mill section showing a cross section similar to FIG. 14 (but rotated slightly counterclockwise), and with the center assembly shown in side view with a lowermost portion broken away to reveal internal details in cross section.

Referring to FIG. 16, this view of mill section 28 shows a cross section of bit sub 192, insert 200, and primary mill 210, but rotated slightly counterclockwise from that position in FIG. 14. No fingers 208 are visible in FIG. 16. Center assembly 222 is shown as being received in mill section central bore 220 (FIG. 14). A central passageway 224, for receiving downwardly flowing liquid, is indicated by broken lines.

Center assembly 222 includes a locking mandrel 226 having an upper head 228. Head 228 has a circumferential tool recess 230 (indicated by broken lines) for engagement by a setting tool or retrieval tool. Locking mandrel 226 also has an internally threaded (indicated by broken lines) lower end 232. The locking mandrel, as well as the setting and retrieval tools, are commercially available from Baker Oil Tool Company of Houston, Tex. With head 228 in the illustrated down position (in solid lines), three (only two of which are visible in FIG. 16) circumferentially spaced dogs 234 are in their extended positions so as to extend into the insert recess 202. A side view of one dog 234 is clearly shown (by a solid line) as extending into insert recess 202. This represents the locked position for normal operation.

It should be apparent from FIGS. 14–16 that, upon rotation of bit sub 192, primary mill 210, and insert 200 as an integral unit with respect to locking mandrel 226, fingers 208 will engage respective dogs 234 to impart rotation to center assembly 222. When setting center assembly 222 within mill section central bore 220 in a locked position, dogs 234 could happen to extend into contact with the upper ends of fingers 208 so as to bend them outwardly, causing fingers 208 to straighten somewhat. However, because fingers 208 are comprised of a flexible and resilient material, they will snap back into their desired positions upon their rotation with respect to dogs 234.

Center assembly 222 also includes a center mill 236 having an externally threaded upper end 238 (indicated by broken lines) threadedly and removably connected to locking mandrel lower end 232. Of course, this connection must be such that center mill 236 rotates with locking mandrel 226 as an integral unit. Center mill 236 also has an abrasive lower end 240 adjacent to primary mill lower end 216 when locking mandrel 226 is in the locked position as shown. Center mill lower end 240 has an abrasive lower layer 242 similar to abrasive lower layer 218 of primary mill lower end 216. A mill nozzle 244 (preferably tungsten carbide) is threadedly and removably connected to and in center mill lower end 240 so as to be in communication with center assembly passageway 224. As shown, mill nozzle 244 has a passageway which tapers from an inlet, having an inlet diameter, to an outlet having an outlet diameter smaller than the inlet diameter. The inlet end of mill nozzle 244 sealingly engages an O-ring. Center mill 236 also has a pair of packing rings 246 in circumferential recesses for sealing against the inner surface of primary mill 210. A shoulder 248 mates with shoulder 214 (FIG. 14).

To remove center assembly 222 from its locked position in FIG. 16, a retrieval tool is used to engage tool recess 230, and head 228 is pulled up to its up position shown in phantom lines. A shaft 250 (also shown in phantom lines) is connected to head 228 and extends out of locking mandrel 226 when retracting dogs 234 to their retracted positions. One dog 234 is shown by phantom lines in its retracted position. Center assembly 226 can now be pulled upwardly out of mill section central bore 220 (FIG. 14) with the retrieval tool.

Center assembly 222 can be reinserted with dogs 234 in their retracted positions, and then locked in position by using a setting tool to engage tool recess 230 and push head 228 back down to extend dogs 234 to their extended and locked positions.

With reference to FIG. 14 as well as FIG. 6, the mill section is connectable to the jet pump section. Bit sub upper end 194 can be threadedly connected to the internally threaded lower end of body portion 142 so that mill section central bore 220 is aligned with the outlet 140 of pump section central bore 136.

Since the mill section has a center assembly that can be removed, and the various sections, including the mill section, have substantially straight central bores which are aligned when connected together as shown in FIG. 1, a tool can be lowered by wireline through the central bores below the mill section after removal of the center assembly.

This has particular advantages in connection with well control whenever it becomes necessary in the course of an underreaming operation to pull the hydraulic underreamer out of the well. This is sometimes necessary because of unanticipated events, such as mechanical problems or plugging of some part of the underreamer. Because a gas cap containing methane can form below the packer section, as previously discussed, simply pulling out of the "live" well could result in a sudden and potentially dangerous release of methane into the atmosphere. The usual practice is to first "kill" the well before pulling out by use of a dense liquid or "mud" which tends to fill coal seam cleats with particles and decrease future productivity.

The invention, however, allows lowering of an inflatable plug through the central bores and below the mill section in the well casing after removal of the center assembly. After inflation of the inflatable plug to obtain a seal in the well casing, the underreamer can be pulled out of the well casing. Using a suitable sealing mechanism at the surface, such as a lubricator, the inflatable plug can be deflated, pulled out of the well, and replaced with a drillable cast iron bridge plug without losing the desired seal. The underreamer, with the center assembly set back in the mill section, is then lowered back into the well casing and liquid flow is started, which establishes a seal of the packer section in the well casing. While rotating with liquid streaming from the mill nozzle, the mill section drills through the bridge plug. Plug fragments which are sufficiently small are drawn by the jet pump section upward between its body and the well casing. The space between the outer surface of the body and the well casing is typically less than ¼ inch. Therefore, the external grooves (most clearly shown at 160 in FIG. 13) in the body allow for larger plug fragments to enter the jet pump section to be pumped to the surface. After drilling through the bridge plug, the underreamer is lowered into the wellbore to the desired depth and the underreaming operation can resume. Note that this operation according the invention did not require killing the well, and thus avoids the consequent adverse effect upon productivity.

Finally, with respect to the various nozzles previously described in the cutting, jet pump, and mill sections, such nozzles are all removable, and thus changeable. This allows excellent hydraulic control for the purpose of optimizing hydraulic efficiency and the ability to adapt the hydraulic underreamer to a wide range of well conditions such as, but not limited to, depth of the well, methane pressure in the coal seam, and thickness of the coal seam.

Obviously, many modifications and variations of the present invention are possible in light of the above teachings. For example, although six turn chambers, ejector nozzles, and venturis are employed in the above-described preferred embodiment of the jet pump section, a fewer or greater number could be used (i.e. three to eleven). It is, therefore, to be understood that within the scope of the appended claims, the invention may be practiced otherwise than as specifically described.

That which is claimed is:

1. A hydraulic underreamer comprising a number of sections connected together in a string as follows:

a packer section which includes (i) a tubular drive bushing having an upper end and a lower end, (ii) a tubular packer mandrel having an upper end and a lower end, the packer mandrel being mounted on the drive bushing with the packer mandrel lower end being closely adjacent to but not connected to the drive bushing upper end so that the drive bushing may rotate while the packer mandrel remains stationary, (iii) at least one tubular sealing element received on and around the packer mandrel, and (iv) a tubular drive mandrel defining a packer section central bore therethrough and substantially coaxially extending through the drive bushing and packer mandrel so as to define a packer section annulus, the tubular drive mandrel being fixedly connected to the drive bushing so that rotation of the drive mandrel rotates the drive bushing;

an intermediate section comprising a coaxial pipe string defining an intermediate section central bore and an intermediate section annulus, the intermediate section having an upper end, at which the intermediate section central bore and annulus respectively communicate with the packer section central bore and annulus, and also a lower end;

a cutting section which includes (i) an outer pipe, (ii) an inner pipe defining a cutting section central bore therethrough and extending substantially coaxially through the outer pipe to define a cutting section annulus between the inner and outer pipes, the cutting section central bore and annulus being in respective communication with the intermediate section central bore and annulus at the intermediate section lower end, (iii) a cutting nozzle housing extending through the cutting section annulus between the inner and outer pipes so as to be fixedly connected thereto, the cutting nozzle housing having an inlet portion in communication with the cutting section central bore and also having an outlet portion, (iv) a baffle mounted in the housing inlet portion, and (v) a cutting nozzle mounted in the housing outlet portion;

a jet pump section which includes (i) a body having a longitudinal axis, a longitudinally extending pump section central bore with an upper end defining an inlet in communication with the cutting section central bore and a lower end defining an outlet, and a plurality of turn chambers circumferentially spaced around the pump section central bore, each turn chamber having at least one inlet passageway, in communication with the pump section central bore, and also having an outlet, (ii) a plurality of ejector nozzles corresponding to the plurality of turn chambers such that each ejector nozzle has an inlet in communication with a corresponding turn chamber outlet, each ejector nozzle also having an outlet, and (iii) a plurality of venturis corresponding to the plurality of ejector nozzles such that each venturi has an inlet aligned with but spaced above a corresponding ejector nozzle outlet, each venturi also having an outlet, wherein the body further has defined therein a diffusion chamber surrounding the pump section central bore, the diffusion chamber having a plurality of inlets in respective communication with the venturi outlets and also having a substantially annular outlet adjacent to the inlet of the pump section central bore and in communication with the cutting section annulus; and a mill section which includes (i) a tubular bit sub having an upper end and a lower end, (ii) a tubular primary mill having an upper end, removably connected to the bit sub lower end, and also an abrasive lower end; and (iii) a center assembly having a passageway therethrough and adapted to be received in a mill section central bore defined in the bit sub and primary mill and aligned with the outlet of the pump section central bore, wherein the center assembly includes (a) a locking mandrel having an upper end and a lower end and being selectively lockable in the mill section central bore, (b) a center mill having an upper end removably connected to the locking mandrel lower end and also having an abrasive lower end adjacent to the primary mill lower end when the locking mandrel is locked in the mill section central bore, and (c) a mill nozzle connected to the center mill lower end so as to be in communication with the center assembly passageway.

2. A hydraulic underreamer as recited in claim 1 wherein the packer section central bore, the intermediate section central bore, the cutting section central bore, the pump section central bore, and the mill section central bore are straight and aligned.

* * * * *